United States Patent [19]

Hall

[11] 4,339,071

[45] Jul. 13, 1982

[54] COIN BANK

[76] Inventor: A. Douglass Hall, David's Hill Rd., Bedford Hills, N.Y. 10507

[21] Appl. No.: 158,219

[22] Filed: Jun. 10, 1980

[51] Int. Cl.[3] ..... A47G 29/00

[52] U.S. Cl. ..... 232/5; 133/1 A

[58] Field of Search ..... 232/4, 5; 133/1 A, 8 A; 53/254, 213

[56] References Cited

U.S. PATENT DOCUMENTS

| | | | |
|---|---|---|---|
| 2,444,804 | 7/1948 | Carruthers | 133/1 A X |
| 3,882,659 | 5/1975 | Charlop | 53/254 |
| 4,036,358 | 7/1977 | Kelley | 133/1 A X |
| 4,091,599 | 5/1978 | Lemieux | 133/1 A X |
| 4,153,197 | 5/1979 | Hall | 232/5 |
| 4,244,157 | 1/1981 | Vondra | 133/1 A X |

FOREIGN PATENT DOCUMENTS

| | | | |
|---|---|---|---|
| 553110 | 12/1930 | Fed. Rep. of Germany | 53/254 |
| 2810619 | 9/1979 | Fed. Rep. of Germany | 133/1 A |

*Primary Examiner*—Roy D. Frazier
*Assistant Examiner*—Peter A. Aschenbrenner
*Attorney, Agent, or Firm*—Pennie & Edmonds

[57] ABSTRACT

A coin bank including a plurality of tubular members for containing stacks of coins with the tubular members having diametrically opposed finger slots. The finger slots extend longitudinally of the tubular members a distance at least equal to the height of the stack of coins therein. The opposite wall sections of the tubular members between the slots are flexibly connected at the base of the members to permit holding of the coins therein.

10 Claims, 6 Drawing Figures

FIG. 1
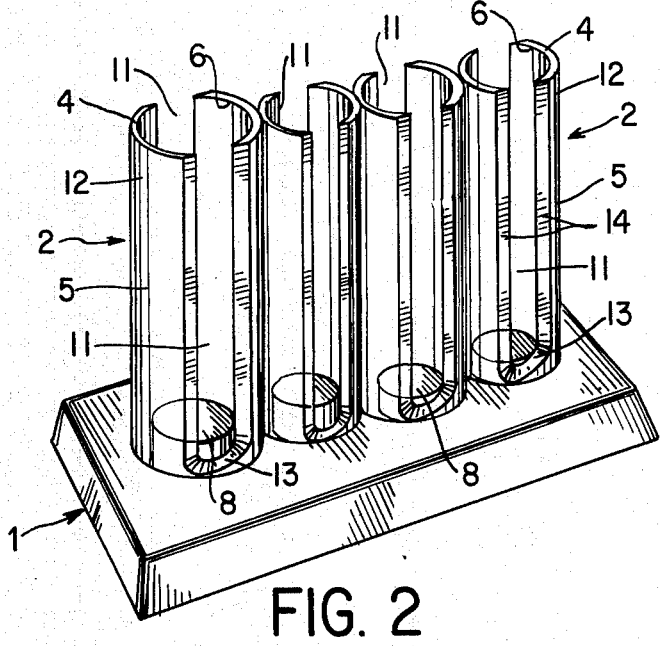
FIG. 3
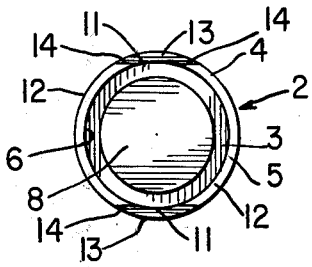
FIG. 4
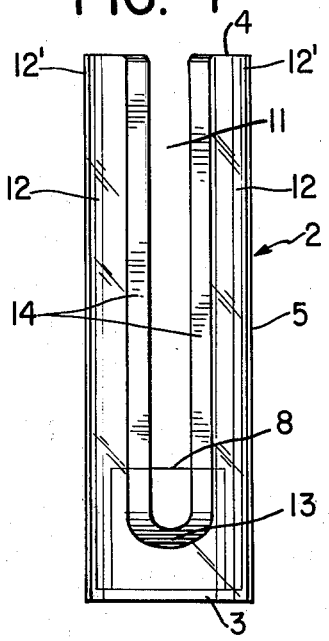
FIG. 2
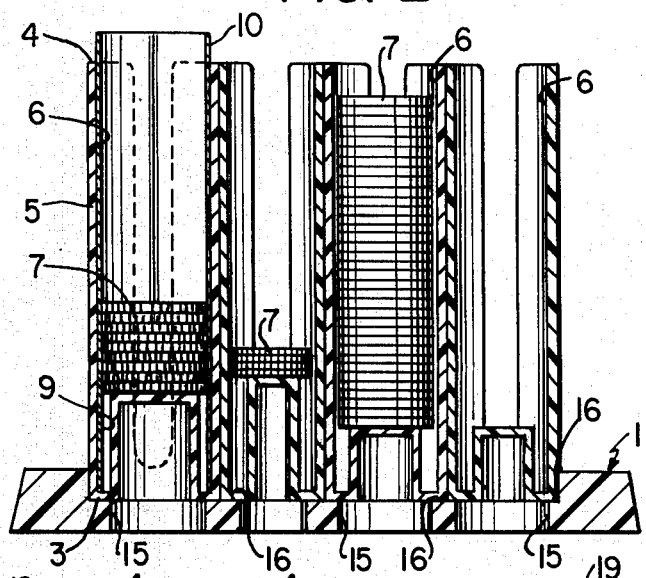
FIG. 5
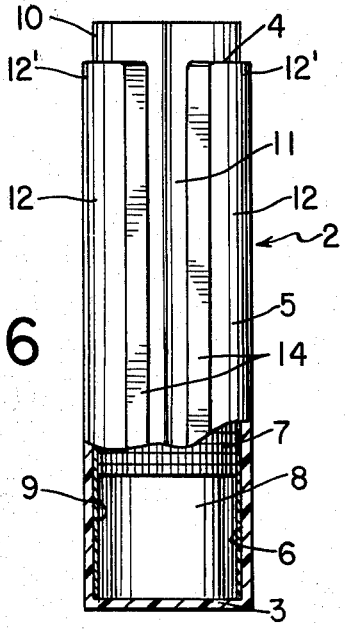
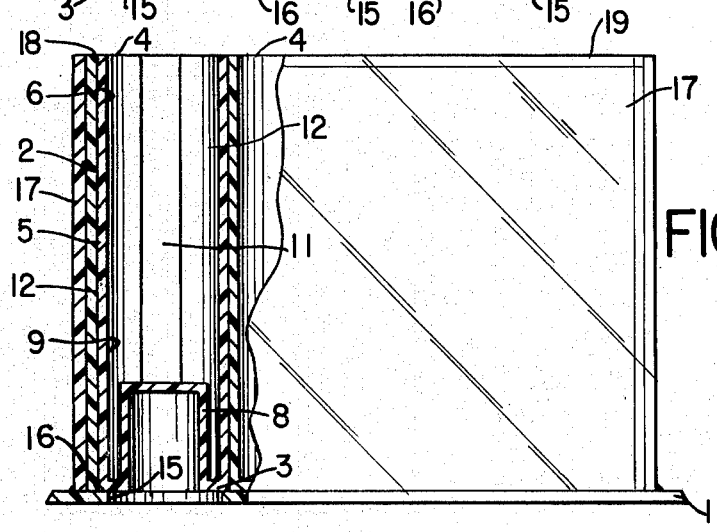
FIG. 6

COIN BANK

TECHNICAL FIELD

The invention relates to a coin bank for individually stacking coins of different denominations in separate stacks either for general organization of loose coins which may be easily extracted from any stack in any desired quantity or for filling the exact amount in standard coin wrappers.

BACKGROUND ART

Coin banks described herein include a plurality of tubular members which function as storage tubes for stacks of coins of different denominations. Each tube is secured to a support member and includes a cylindrical wall defining a predetermined inner wall surface of a cross-sectional dimension configured to receive coins having a lesser cross-sectional area. The effective height of each tubular member is equal to the number of coins which will form a stack sufficient to fill a standard coin wrapper of the particular denominations of coins in that tubular member. A clearance space is provided between the inner wall of each tubular member and the stack of coins contained therein for insertion of the wrapper around the stack of coins. Applicant's U.S. Pat. No. 4,153,197 discloses a bank construction of the type described above and to which the present invention is directed.

With the bank construction of applicant's previous patent, the tubular members are permanently fixed to the support with each tubular member configured to receive a stack of coins of different denominations, as for example, quarters, dimes, nickels and pennies. Each tubular member includes a groove extending longitudinally along the inner wall thereof for engaging the creased portion of the coin wrapper to permit guiding thereof around the stack of coins. A unitary top covering the tubular members is provided to retain the coins therein. The cover of the coin bank includes two openings oriented to overlie two non-adjacent tubular members when placed in one position and to overlie the other two non-adjacent tubular members when placed in a second position. The openings in the cover permit insertion of the wrappers into the underlying tubular members; and when it is desired to remove any one of the stack of coins, the cover is positioned with one opening overlying that stack. It is then simply sufficient to cover the other opening with the individual's finger and invert the entire bank. The wall of the cover will prevent spillage of coins from the other tubular members.

With the construction disclosed in U.S. Pat. No. 4,153,197, it is always necessary to properly align the cover in order to remove the stack of coins from any individual tubular member. Also, removal of a partial stack of coins requires inverting of the entire bank and counting of the coins as they are removed.

DISCLOSURE OF THE INVENTION

In accordance with the teachings of the present invention, coin banks of the type disclosed in U.S. Pat. No. 4,153,197 are improved to facilitate individual handling of the stacks of coins in any one of the tubular members. Each tubular member includes diametrically opposed finger slots extending the length of the coins to be stacked therein. These finger slots permit the individual to grasp the coins in the stack from opposite sides and thereby permit removal of any number of coins in the stack. The slots also provide room for the creases of coin wrappers so that the wrappers may be easily inserted about the coins; and again, the entire stack may be removed by grasping of the wrapper through the slots.

The coins in each tubular member are supported on pedestals which are spaced from the inner wall of the tubular member. This spacing provides a clearance for the coin wrapper to be inserted beyond the bottommost coin in the stack. This in turn permits grasping of the wrapper against the bottommost coin so as to properly hold the stack within the wrapper as it is removed from the tubular member. In addition, the individual tubular members are removably mounted on the support so that they can be individually removed. The coins, with or without the wrapper, can thus be removed from the tubular member, if desired, by inverting the tubular member and without interfering with the other stacks of coins held in the other tubular members.

BRIEF DESCRIPTION OF THE DRAWINGS

FIG. 1 is a perspective view of the coin bank constructed according to the teachings of the present invention;

FIG. 2 is a side cross-sectional view of the bank shown in FIG. 1;

FIG. 3 is a top view of one of the tubular members of the coin bank;

FIG. 4 is a side view of the tubular member shown in FIG. 3;

FIG. 5 is a side view of the tubular member shown in FIG. 4 and showing a coin wrapper inserted therein, parts of the structure being broken away for clarity; and FIG. 6 is a side view of a modified embodiment of the present invention partially broken away to show the internal structure thereof.

DETAILED DESCRIPTION OF THE INVENTION

As shown in the drawings, the coin bank generally includes a support 1 and a plurality of generally tubular members 2 upstanding from one side of the support. Each tubular member includes a base 3 and a top 4 connected together by a cylindrical wall 5. The cylindrical wall has an inner wall surface 6 of predetermined cross-sectional area configured to receive coins 7 having a preselected lesser cross-sectional area. A pedestal 8 on which the coins are stacked extends upwardly from the base 3. The height of the pedestal in each tubular member is such as to provide that tubular member with an effective height, as measured to the top 4, equal to the height of a stacked plurality of coins sufficient to fill a standard coin wrapper suited for the denomination of coins received therein. The cross-sectional area of the inner wall surface of each tubular member in relation to the coins therein defines a clearance space 9 having a width sufficient to permit insertion of a standard coin wrapper 10. The construction of the bank as described is conventional and may be as generally described in U.S. Pat. No. 4,153,197.

In accordance with the teachings of the present invention, the tubular members are each provided with diametrically located longitudinal extending slots 11. These slots extend the full height of the stacked coins from the bottommost coin to the top of the tubular member. Also, the width of the slots is sufficient to permit grasping of the coins therein by the fingers of an individual. It will be appreciated that the grasping is on opposite sides of the stack of coins so that they may be properly held by two fingers while the fingers are slid along these slots upwarding of the tubular member. The opposite wall sections 12 of each tubular member are free from each other for the full length of the slots so as to provide free ends 12' at the top of the tubular member.

As shown in FIG. 4, the slots terminate at lower ends 13 before reaching the base 3 of the tubular member. However, they extend downwardly below the upper surface of the pedestal 8 on which the coins are to be stacked so that the lowermost coin in the stack can be readily gripped. With this construction, the opposite wall sections are effectively flexibly connected to the base of the tubular member. This permits pressing of the wall sections, preferably at their upper ends, toward each other into frictional holding relationship with the coins stacked therein.

As shown in FIG. 3, the edges 14 of the wall sections of each tubular member on opposite sides of the slots are beveled and face radially outwardly of the tubular member. This beveling permits the individual's fingers to be partially inserted into the tubular member as they are pressed against the member in the area of the slots.

As described above, each tubular member provides a clearance space 9 for insertion of a coin wrapper 10. In accordance with the teachings of the preferred embodiment of the invention, this clearance space extends downwardly below the bottommost coin in the stack. To permit this, the pedestal 8 has a cross-sectional dimension less than the cross-sectional dimension defined by the inner wall 6 of the tubular member. Specifically, the pedestal has a cross-sectional dimension less than the diameter of the coins to be stacked in the particular tubular member so as not to interfere with the insertion of the wrapper downwardly beyond the bottommost coin of the stack. By permitting the wrapper to be inserted below the bottommost coin in the stack, the wrapper can be grasped through the slots by opposed fingers of the individual and pressed into holding relationship with the bottommost coin. Thus, subsequent removal of the stack within the wrapper is assured without spillage of coins from the bottom of the stack and without requiring inversion of the tubular member. Also, the distance from the base 3 to the top of the pedestal 8 is such that when the wrapper 10 is inserted into the tubular member and slid all the way down to the base, the wrapper will be centered with respect to the coins. In other words, the ends of the wrapper will extend evenly beyond each end of the stack of coins. Thus, the upper end of the wrapper can be closed even before the coins are removed from the tubular member.

To further permit handling of the coins of each stack, each tubular member is removably mounted in the support. With reference to FIG. 2, the support is provided with openings 15 for insertion of each of the tubular members. Each opening has a bottom ledge 16 on which the tubular member is seated. The opening, however, extends entirely through the support so that the individual's finger can be inserted through the bottom of the support to push against the bottom of the tubular member and remove it from the support. With the construction shown in FIGS. 1–5, the individual tubular members may also be grasped from above the support and pulled out of the openings 15.

In the embodiment disclosed in FIG. 6, the tubular members are all enclosed within a unitary housing 17. The housing is fixed to the support 1 and encloses the tubular members except for the top 4 of each member. With this construction, the openings 15 in the support are necessary for insertion of the individual's finger to effect removal of the individual tubular members out of the top of the housing. For removably containing the individual tubular members within the housing, the housing includes cylindrical shaped openings 18. These openings extend from the support to the top 19 of the housing. The openings are dimensioned to frictionally hold the individually tubular members therein.

I claim:

1. The improvement in a coin bank having a support, a plurality of generally tubular members upstanding from one side of the support with each tubular member including a base and top at opposite ends of a cylindrical wall with an inner wall surface thereof defining a predetermined cross-sectional area configured to receive coins having a preselected lesser cross-sectional area and an effective height equal to the height of a stacked plurality of coins sufficient to fill a standard coin wrapper suited for the particular denomination of coins to be received therein, and a clearance space defined by the inner wall surface of the tubular member and the circumference of the stack of coins stored therein, said clearance space having a width sufficient to permit the insertion of a wrapper into the tube and around the stack of coins, the improvement characterized in that:

(a) the cylindrical wall of each tubular member includes at least two diametrically located longitudinally extending slots extending at least the full height of the stacked coins from the bottommost coin to the top of the tubular member so that upon insertion of the wrapper into the tube, the wrapper can be grasped through said diametrically opposed slots and pressed into holding relationship with the bottommost coin.

2. In the coin bank according to claim 1, the improvement further characterized in that:

(a) the opposite wall sections of each tubular member disposed between said slots are free from each other for the full length of the slots and include free ends at the top of the tubular member.

3. In the coin bank according to claim 2, the improvement further characterized in that:

(a) the opposite wall sections of each tubular member are flexibly connected to the base of the tubular member for pressing toward each other into frictional holding relationship with coins stacked therein.

4. In the coin bank according to claim 3, the improvement further characterized in that:

(a) the edges of the wall sections of each tubular member on opposite sides of the slots are beveled and face radially outwardly of the tubular member.

5. In the coin bank according to any one of claims 1–4, the improvement further characterized in that:

(a) the base of each tubular member includes a pedestal on which the coins are stacked, said pedestal being spaced radially inwardly from the inner wall surface of the tubular member; and (b) said clearance space extends downwardly beyond the bottommost coin in the stack and around the pedestal.

6. In the coin bank according to claim 5, the improvement characterized in that:

(a) the clearance space around the pedestal has a length whereby the wrapper when inserted therein will be centered with respect to a stack of coins in the tubular member.

7. In the coin bank according to claim 6, the improvement further characterized in that:

(a) the outer dimension of the pedestal is no greater than the diameter of the coins stacked thereon.

8. In the coin bank according to claim 7, the improvement further characterized in that:

(a) the tubular members are each removably mounted on said support.

9. The improvement in a coin bank having a support, a plurality of generally tubular members upstanding from one side of the support with each tubular member including a base and top at opposite ends of a cylindrical wall with an inner wall surface thereof defining a predetermined cross-sectional area configured to receive coins having a preselected lesser cross-sectional area and an effective height equal to the height of a stacked plurality of coins sufficient to fill a standard coin wrapper suited for the particular denomination of coins to be received therein, and a clearance space defined by the inner wall surface of the tubular member and the circumference of the stack of coins stored therein, said clearance space having a width sufficient to permit the insertion of a wrapper into the tube and around the stack of coins, the improvement characterized in that:

(a) the cylindrical wall of each tubular member includes diametrically located longitudinally extending slots extending at least the full height of the stacked coins from the bottommost coin to the top of the tubular member;

(b) the base of each tubular member includes a pedestal on which the coins are stacked, said pedestal being spaced radially inwardly from the inner wall surface of the tubular member;

(c) said clearance space extends downwardly beyond the bottommost coin in the stack and around the pedestal;

(d) the clearance space around the pedestal has a length whereby the wrapper when inserted therein will be centered with respect to a stack of coins in the tubular member;

(e) the outer dimension of the pedestal is no greater than the diameter of the coins stacked thereon;

(f) the tubular members are each removably mounted on said support;

(g) said tubular members are all enclosed within a unitary housing except at the top thereof, said housing being fixed to said support; and (h) said support includes openings aligned with the base of each tubular member to permit insertion of an individual's finger and pushing of the individual tubular members out the top of the housing.

10. In the coin bank according to claim 9, the improvement further characterized in that:

(a) the housing includes cylindrically shaped openings extending from the support to the top thereof for receipt of each of said tubular members.

* * * * *